United States Patent [19]

Chutter et al.

[11] 4,089,437

[45] May 16, 1978

[54] COLLAPSIBLE CO-DISPENSING TUBULAR CONTAINER

[75] Inventors: Raymond Allen Chutter; Paul James Green; Robert Lee Hofmann; Daniel Rose Long, all of Cincinnati, Ohio

[73] Assignee: The Procter & Gamble Company, Cincinnati, Ohio

[21] Appl. No.: 697,517

[22] Filed: Jun. 18, 1976

[51] Int. Cl.[2] ..... B65D 35/24

[52] U.S. Cl. ..... 222/94

[58] Field of Search ..... 222/94, 107; 215/6; 220/22

[56] References Cited

U.S. PATENT DOCUMENTS

| | | | |
|---|---|---|---|
| 1,894,115 | 1/1933 | Murphy | 222/94 |
| 2,611,499 | 9/1952 | Mayer | 215/6 |
| 3,388,823 | 6/1968 | Fleming et al. | 220/22 X |
| 3,506,157 | 4/1970 | Dukess | 222/94 |
| 3,645,416 | 2/1972 | Main, Jr. | 220/22 |
| 3,788,520 | 1/1974 | Dukess | 222/94 |
| 3,948,704 | 4/1976 | Evans | 220/22 X |

*Primary Examiner*—Joseph F. Peters, Jr.
*Assistant Examiner*—Normam L. Stack, Jr.
*Attorney, Agent, or Firm*—Thomas J. Slone; Richard C. Witte; John V. Gorman

[57] ABSTRACT

A collapsible co-dispensing tubular container for separately storing and co-dispensing two extrusible product components of substantially equal viscosity with substantially constant proportionation. The container may comprise a collapsible tubular body, a head fitment having two discharge ports which fitment is sealingly secured in one end of the collapsible body, and a longitudinally extending interior bulkhead disposed to partition the interior of the container into two compartments, one of which compartments is in fluid communication with one of the discharge ports, and the other of the compartments being in fluid communication with the other of the discharge ports. The improvement comprises a pressure responsive moveable septum disposed adjacent the head end of the container and which septum is in fluid communication with both of the compartments in the container. The pressure responsive moveable septum precipitates equalization of the pressures on the separately stored product components upon squeezing or otherwise collapsing the container which pressure equalization effects substantially constant proportionation of the product components as they are co-dispensed from the container.

5 Claims, 7 Drawing Figures

COLLAPSIBLE CO-DISPENSING TUBULAR CONTAINER

FIELD OF THE INVENTION

This invention relates to providing collapsible, longitudinally partitioned tubular dispensing containers having two internal compartments for separately storing and co-dispensing two component products with substantially constant predetermined proportions; i.e., constant proportionation.

BACKGROUND OF THE INVENTION

Generally, plural component products which require isolation of their components during storage have such a requirement because of chemical reactions which occur upon mixing the components. A familiar example of such a two component product which must have its components isolated from each other during storage is epoxy adhesive comprising resin and hardener components. The resin and hardener must be stored independently because, upon being mixed, a chemical reaction occurs which causes hardening or setting of the adhesive. Successive batches of resin and hardener are desirable dispensed and mixed in predetermined proportions to achieve uniform, predictable product properties from batch-to-batch.

The prior art discloses a broad variety of collapsible co-dispensing tubular container constructions. See for instance French Pat. No. 961,154, published May 8, 1950 titled "Improvement in Tubes For Ointments Or The Like"; German Pat. No. 580,134, filed July 17, 1931; U.S. Pat. No. 3,290,422, issued Dec. 6, 1966 to Kenneth George Michel; U.S. Pat. No. 3,506,157 issued Apr. 14, 1970 to Joseph Dukess; and, U.S. Pat. No. 3,307,738 issued Mar. 7, 1967 to Christian Theodore Scheindel. Moreover, other co-dispensing tube constructions are disclosed in the co-pending commonly assigned U.S. patent application Ser. No. 601,688 filed Aug. 1, 1975 by Charles R. Hood and Stephen F. Evans titled "Collapsible Longitudinally Partitioned Tubular Dispensing Container", which application is a continuation of now abandoned U.S. patent application Ser. No. 415,468, filed Nov. 13, 1973, both of which applications are hereby incorporated by reference.

A long felt problem associated with collapsible co-dispensing tubular containers has been variations in the ratio of dispensing the two product components. That is, when such containers are operated intermittently (e.g., a toothpaste tube used by a variety of family members throughout the course of a day), variations in grip, squeezing pressure, and the like precipitate variations in the ratio of the product components being co-dispensed. The present invention comprises means near the head end of the container for equalizing the pressures on the two product components so that, at least with respect to product components of substantially equal viscosities, substantially constant proportionation of the co-dispensed components occurs. That is, the two components are caused to be expressed at uniform rates by virtue of being expressed under equal pressures and by virture of having substantially equal viscosities. None of the referenced prior art has solved all of the problems associated with providing constant proportionation from collapsible co-dispensing tubular containers in the manner of nor to the degree of the present invention.

OBJECTS OF THE PRESENT INVENTION

The nature and substance of the instant invention will be more readily appreciated after giving consideration to its major aims and purposes. The principle objects of the invention are recited in the ensuing paragraphs in order to provide a better appreciation of its important aspects prior to describing the details of a preferred embodiment and other embodiments in later portions of this specification. A major object of the present invention is providing a collapsible, longitudinally partitioned tubular co-dispensing container having two longitudinally extending compartments within it for separately storing the components of a two-component product and for simultaneously co-dispensing the components in substantially constant pre-determined proportions.

Another major object of the invention is providing the container as described in the preceding paragraph which container comprises means for assuring that the separately stored product components are expressed under substantially equal pressures when the container is squeezed or otherwise collapsed.

SUMMARY OF THE PRESENT INVENTION

The above and other objects are achieved in accordance with one aspect of the present invention by providing an improved collapsible tubular container for separately storing and co-dispensing two extrusible product components of substantially equal viscosity, which container includes a collapsible tubular body, a head fitment having two discharge ports which fitment is sealingly secured to one end of the body, and a longitudinally extending interior bulkhead disposed to partition the interior of the container into two compartments, one of the compartments being in fluid communication with one of the discharge ports and the other of the compartments being in fluid communication with the other of the discharge ports. The improvement comprises a sufficiently pressure responsive moveable barrier means disposed adjacent the end of the tubular body which is secured to the head fitment and which means are in fluid communication with both of the compartments in the container so that, when the compartments have product components of substantially equal viscosity separately stored therein, upon squeezing the container to effect co-dispensing of the product components, the pressure responsive movable barrier means will be moved by pressure differential developed thereacross until the pressure differential is substantially vitiated. By thus vitiating pressure differential with respect to the two product components, co-dispensing of substantially constant proportions of the product components are assured because the components are expressed under substantially equal pressures. The pressure responsive moveable barrier means may comprise either a corrugated septum of flexible material, or a flaccid septum. Such septums can be either integral portions of the interior bulkhead of the container, or they may be discrete components which are sealingly secured to the interior bulkhead in such a manner that they obviate internal fluid communication between the compartments of the tube through the bulkhead.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

DESCRIPTION OF THE PREFERRED EMBODIMENT

Figure 1:
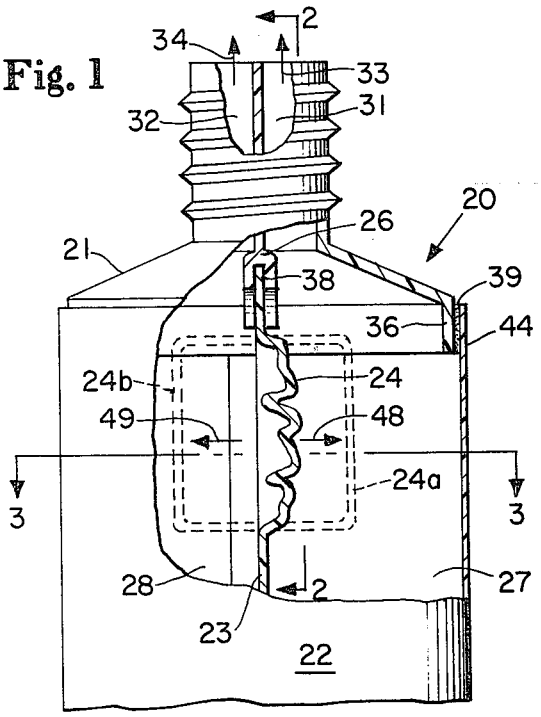
FIG. 1 is a fragmentary, partially cut away view of a collapsible co-dispensing tubular container which container is a preferred embodiment of the present invention.

Container assembly 20, FIG. 1, is a preferred embodiment of the present invention which container assembly comprises the head fitment 21, and a tubular body 22 having a longitudinally extending interior bulkhead 23, and which bulkhead includes septum 24 which is a pressure responsive moveable barrier means. The interior bulkhead 23 cooperates with a divider wall 26 in the head fitment 21 to partition the interior of the container into two compartments which are designated 27 and 28.

Briefly, container 20, FIG. 1, is a collapsible co-dispensing tubular container for separately storing and co-dispensing two extrusible product components of substantially equal viscosity with substantially constant proportionation. The pressure responsive moveable septum 24 is disposed adjacent the head fitment 21 and is in fluid communication with both of the compartments 27 and 28 in the container 20. Septum 24 precipitates equalization of pressures on product components which are separately stored in compartments 27, 28 upon squeezing or otherwise collapsing container 20. That is, in the event unequal pressure is developed on the product components separately stored in compartmens 27, 28 upon squeezing the container 20, septum 24 will be displaced by the higher pressure component until pressure equalization occurs. This pressure equalization effects substantially constant proportionation of the product components as they are then simultaneously expressed from the container 20 through passageways 31, 32 as indicated by arrows 33, 34 respectively.

The head fitment 21, FIG. 1, of the preferred embodiment container 20 is injection molded of a thermoplastic material such as high density polyethylene. It comprises divider wall 26 and an outer wall 36 which, together, define back-to-back discharge passageways 31, 32. Head fitment 21 is so configured that it can be molded directly onto one end of the tubular body 22. Alternatively, head fitment 21 can be molded as a discrete component which can subsequently be sealingly secured to the tubular body 22 along a chordal seam 38 and a circumferential seam 39.

Figure 3:
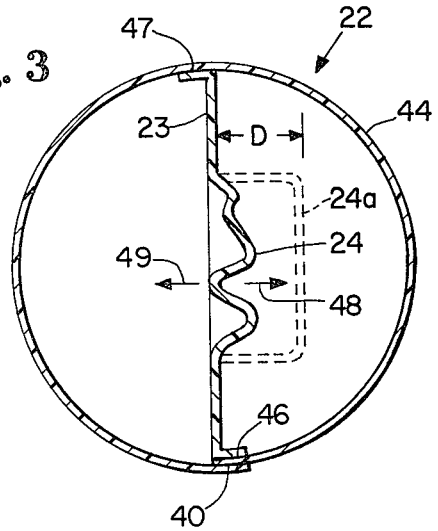
FIG. 3 is a transverse sectional view of the container shown in FIG. 1 taken along line 3—3 thereof.

The tubular body 22, FIG. 3, of the preferred embodiment container 20 comprises a tubular wall 44 having a longitudinally extending seam 40, and a discrete chordal interior bulkhead 23 which is sealingly secured in the tubular wall 44 along two more longitudinally extending seams 46 and 47.

The tubular wall 44 of the preferred embodiment container 20 is preferably made from laminated sheet stock having an aluminum foil inner lamina which is sandwiched between outer laminae of compatible, heat sealable thermoplastic materials. Such a laminated sheet stock may comprise dead soft aluminum foil having a nominal thickness of two mils sandwiched between low density polyethylene laminae having nominal thicknesses of three-to-four mils each. For simplicity, the laminae of the tubular wall 44 are not shown individually in the Figures.

Figure 2:
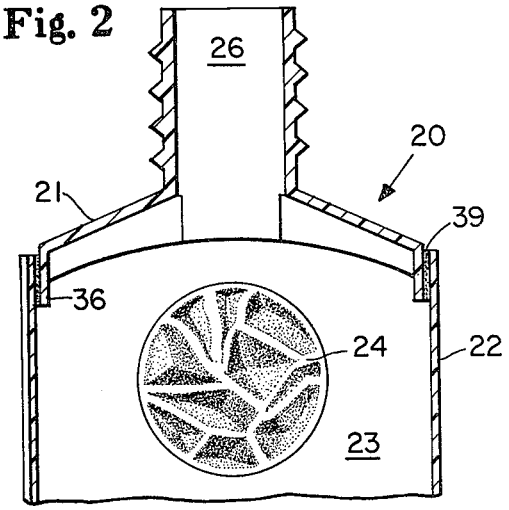
FIG. 2 is a fragmentary sectional view of the container shown in FIG. 1 taken along line 2—2 thereof.

The chordal interior bulkhead 23, FIGS. 1, 2, and 3, of the preferred embodiment container 20 comprises very flexible or flaccid thermoplastic sheet material such as low density polyethylene having a nominal thickness of from about one mil to about three mils.

Septum 24 of the preferred embodiment container 20 is an embossed, hat-shape integral portion of bulkhead 23. In FIGS. 1 and 3, designator 24*a* identifies septum 24 with dashed lines showing its as-formed, hat-shape. Similarly, designator 24*b*, FIG. 1, shows septum 24 displaced to a position opposite from its position designated 24*a*. As shown in solid lines in FIGS. 1 and 3, spetum 24 is normally substantially collapsed so that it is disposed in or adjacent the plane of the chordal bulkhead 23.

Septum 24 is sufficiently small with respect to the size of the tubular wall 44 to obviate its blocking flow of product components through the tubular body 22. For instance, in a tubular body having an internal diameter of about one-and-one-quarter-inch, a hat-shape, substantially cylindrical septum 24 having a nominal diameter of about one inch and a nominal depth D, FIG. 3, of from about one-quarter-inch to about one-half inch was thermoformed in the chordal bulkhead 23 before bulkhead 23 was sealingly secured (as by being heat sealed) within the tubular wall 44.

Container 20, FIG. 1, is made as described hereinbefore. That is, the head fitment 21 is either molded onto the end of the tubular body 22 adjacent the septum 24 or a discrete head fitment 21 is sealingly secured thereto along the chordal seam 38 and the circumferential seam 39.

Collapsible containers such as container 20 are commonly provided witha cap (not shown); then inverted and filled through their bottom ends. After being filled, the bottom is sealed closed with, for instance, a transverse seam (not shown). After container 20 has been filled, septum 24 is, as shown in FIGS. 1 and 3, substantially collapsed so that it can be displaced in either direction indicated by arrows 48 and 49 by a nominal pressure differential across it.

In operation, container 20 may be squeezed intermittently to dispense small portions of the components of a two component product. When such containers are grasped by a variety of users having individual grips, such squeezing can develop greater pressure on one component than the other. When this occurs, the pressure differential across septum 24 moves septum 24 until the pressures equalize. Thus, septum 24 is a pressure responsive moveable barrier means for equalizing component pressures whereby relatively constant proportionation of co-dispensed product components is achieved. That is, because both product components are expressed or dispensed under equal pressure, their relative flow rates will be determined principally by the relative cross sectional areas of their respective discharge passageways.

ALTERNATIVE EMBODIMENTS OF THE INVENTION

Figure 4:
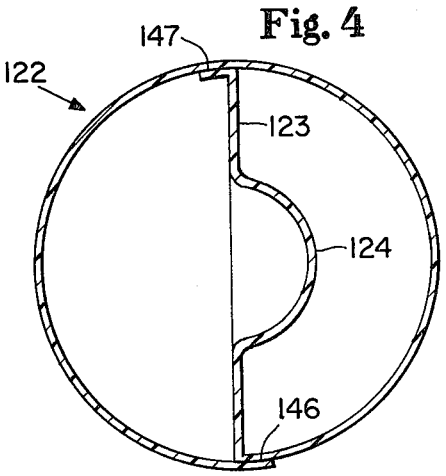
FIG. 4 is a transverse sectional view of an alternate embodiment container.
Figure 5:
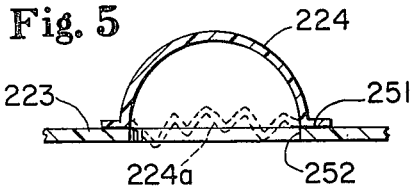
FIG. 5 is a fragmentary sectional view of a hemispherical-shape discrete flaccid septum showing it in its as-formed shape (solid lines) and its collapsed state (dashed lines).
Figure 6:
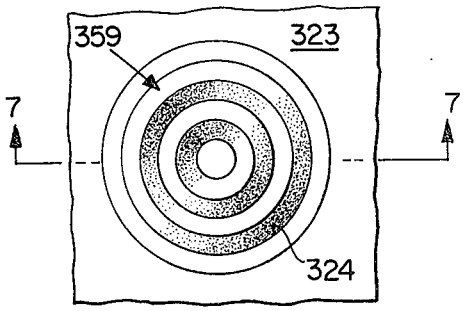
FIG. 6 is an elevational view of a corrugated septum embodiment of the present invention.
Figure 7:
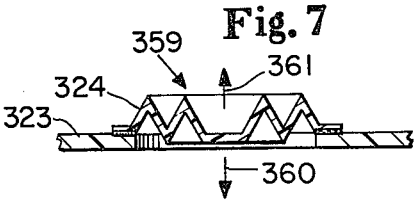
FIG. 7 is a fragmentary sectional view taken along line 7—7 of FIG. 6.

Briefly, FIGS. 4–7 show features of alternate embodiment containers which features include a unitary tubular body 122, FIG. 4, and two forms of discrete septums; septums 224 and 324, FIGS. 5 through 7. To avoid undue repetitious descriptions, it is understood that these features are incorporated in container constructions similar to the preferred embodiment container 20 as described hereinabove.

FIG. 4 shows an alternative tubular body 122 of an alternative embodiment of the present invention wherein the tubular body 122 is a unitary structure. The unitary structure is formed from a single sheet of embossible thermoplastic material which is sufficiently flexible or flaccid to emboss or otherwise incorporate a bubble-shape septum 124 therein. For instance, such a tubular body 122 can be formed from a sheet of low density polyethylene by thermoforming septum 124 therein, and then forming the sheet into the cross sectional configuration shown in FIG. 4 and heat sealing the longitudinally extending seams 146 and 147 thereof.

FIG. 5 shows a fragmentary portion of an alternative chordal partition wall 223 having a discrete hemispherical-shape septum 224 sealingly secured thereto along a circular seam 251 about the perimeter of a hole 252 therethrough. This construction is useful for instance when the chordal partition wall comprises material that is insufficiently flexible to form a pressure responsive moveable septum integrally therefrom. For instance, if the material from which the chordal partition wall 223 is formed is the polyethylene-aluminum foil-polyethylene laminate described hereinbefore, the discrete septum 224 can be made from low density polyethylene and subsequently heat sealed to either surface of the partition wall 223. Designator **224*a* identifies, in dashed lines, septum 224 in a substantially collapsed state whereas the solid lines of 224 indicate the as-molded shape of septum 224**.

FIGS. 6 and 7 are fragmentary frontal and sectional views respectively of another discrete septum 324 comprising concentric corrugations which septum 324 is sealingly secured along an endless seam 351 to a partition wall 323 in the same manner shown in FIG. 5 and described hereinabove. When the septum 324 is thus affixed, its central portion 359 is free to be displaced in either direction indicated by arrows 360, 361 in FIG. 7 by pressure differentials developed across the septum.

Referring back to the construction of bulkhead 23, FIGS. 1–3, bulkhead 23 can be substantially planar and comprise substantially flexible but inelastic embossible material having a degree of flexibility inversely related to its thickness. But for septum 24, bulkhead 23 can comprise sufficiently thick such material to be relatively inflexible, and septum 24 can comprise an embossed integral portion of bulkhead 23 of sufficiently lesser thickness with respect to the remainder of bulkhead 23 that the embossed portion or septum 24 is relatively flaccid with respect to the remainder of bulkhead 23.

While the preferred embodiment of the present invention has been illustrated and described as comprising a head fitment, a cylindrical tubular body, and a diametral bulkhead having a flaccid septum thermoformed therein, it is not intended to thereby limit the present invention. Rather, it will be obvious to those skilled in the art that various changes and modifications can be made without departing from the spirit and scope of the invention. It is intended, therefore, to cover in the appended claims all such changes and modifications that are within the scope of this invention.

What is claimed is:

1. An improved collapsible tubular container for separately storing and co-dispensing two extrusible product components of substantially equal viscosity, the container including a collapsible tubular body, a head fitment having two discharge passageways which fitment is sealingly secured to one end of said body, and a longitudinally extending iterior bulkhead disposed to sealingly partition the interior of said container into two compartments, one of said compartments being in fluid communication with one of said discharge passageways and the other of said compartments being in fluid communication with the other of said discharge passageways, said improvement comprising a sufficiently pressure responsive moveable barrier means disposed adjacent only said one end and in fluid communication with both said compartments adjacent the interior ends of said discharge passageways, said pressure responsive moveable barrier means comprising a septum of material having a substantially greater degree of flexibility than said bulkhead, said septum being sufficiently moveable by such pressure differential as may be developed thereacross upon squeezing said container to effect co-dispensing to substantially vitiate said pressure differential whereby substantially constant proportion co-dispensing of said product components through said discharge passageways is assured during said squeezing because the components are under substantially equal pressures adjacent corresponding portions of said discharge passageways.

2. The improved collapsible tubular container of claim 1 wherein said interior bulkhead is provided with a hole therethrough adjacent said one end, and said septum is a discrete component which is sealingly secured to said bulkhead adjacent the perimeter of said hole so that said septum obviates internal fluid communication between product components disposed in said compartments via said hole.

3. The improved collapsible tubular container of claim 1 wherein said septum comprises an embossed integral portion of said bulkhead, and said embossed portion is sufficiently small to obviate its blocking flow of said product components to or through said passageways.

4. The improved collapsible tubular container of claim 3 wherein said embossed portion of said bulkhead has a substantially hemispherical shape when formed.

5. The improved collapsible tubular container of claim 3 wherein said interior bulkhead is substantially planar and comprises substantially inelastic embossible material having a degree of flexibility inversely related to its thickness and, but for said septum, said bulkhead comprises sufficiently thick said material to be relatively inflexible, and said septum comprises an embossed integral portion of said bulkhead of sufficiently lesser thickness with respect to the remainder of said bulkhead that said embossed portion is relatively flaccid with respect to said remainder.

* * * * *